US006943330B2

(12) United States Patent
Ring

(10) Patent No.: US 6,943,330 B2
(45) Date of Patent: Sep. 13, 2005

(54) INDUCTION HEATING SYSTEM WITH RESONANCE DETECTION

(75) Inventor: Edmund J. Ring, Circle Pines, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 26 days.

(21) Appl. No.: 10/671,069

(22) Filed: Sep. 25, 2003

(65) Prior Publication Data

US 2005/0067410 A1 Mar. 31, 2005

(51) Int. Cl.[7] ..... H05B 6/04
(52) U.S. Cl. ..... 219/661
(58) Field of Search ..... 219/600, 626–627, 219/634, 661–668; 363/49, 131, 172; 373/139, 148

(56) References Cited

U.S. PATENT DOCUMENTS 3,757,197 A * 9/1973 Bailey ..... 363/49
3,777,100 A * 12/1973 Trine ..... 219/660
4,017,701 A 4/1977 Mittelmann
4,277,667 A 7/1981 Kiuchi
4,292,487 A * 9/1981 De Leon ..... 219/667
4,355,222 A 10/1982 Geithman et al.
4,356,371 A 10/1982 Kiuchi et al.
4,359,620 A 11/1982 Keller
4,467,165 A 8/1984 Kiuchi et al.
5,414,247 A 5/1995 Geithman et al.
5,504,309 A 4/1996 Geissler
5,648,008 A * 7/1997 Barritt et al. ..... 219/661
5,752,148 A 5/1998 Yoneda et al.
5,789,721 A 8/1998 Hayashi et al.
6,163,019 A * 12/2000 Green et al. ..... 219/660
6,288,375 B1 9/2001 Lappi et al.
6,649,888 B2 * 11/2003 Ryan et al. ..... 219/661

* cited by examiner

*Primary Examiner*—Tu Hoang
(74) *Attorney, Agent, or Firm*—Pamela L. Stewart

(57) ABSTRACT

An induction heating is provided. The induction heating system comprises a power switch, a resonant heating circuit, and a pulse initiator. The resonant heating circuit is configured to be coupled to a load and configured to generate an oscillating voltage in response to a DC pulse input having a DC voltage level. The pulse initiator is configured to provide a monitoring voltage having a value representative of an average value of a peak voltage of the oscillating voltage generated by the resonant heating circuit and to provide a pulse initiation signal to initiate application of a subsequent DC pulse to the resonant circuit when the value of the monitoring voltage is substantially equal to or less than a predetermined threshold value.

22 Claims, 6 Drawing Sheets

INDUCTION HEATING SYSTEM WITH RESONANCE DETECTION

TECHNICAL FIELD

The present invention relates generally to an induction heating system, and more particularly to an induction heating system employing a pulse initiator to provide safe low-power heating.

BACKGROUND OF THE INVENTION

The term "induction heating" generally describes a process in which an alternating current is passed through a coil to generate an alternating magnetic flux. When the coil is placed in close proximity to or wrapped around a metallic object that is to be heated, the alternating magnetic flux inductively couples the load to the coil and generates eddy currents within the metallic object causing it to become heated. Because of its function, the coil is often referred to as a "work coil" or "induction head," and the metallic object to be heated as a "load". Induction heating may be used for many purposes including curing adhesives, hardening of metals, brazing, soldering, welding, and other fabrication processes in which heat is a necessary agent or catalyst.

The field of induction heating is considered to be well-established, with several types of induction heating systems having been developed to control power delivered to the induction head and, thus, the heat produced in the load. One type of induction heating system, sometimes referred to as a resonant system, generally comprises a power supply, a resonant induction head typically formed by the work coil and a capacitor, and some type of switching means to control delivery of power to the resonant induction head by the power supply. Generally, the switching means is closed to cause the power supply to provide a current to the resonant induction head resulting in energy being stored in the work coil. When the switching means is opened, the induction head begins to generate an oscillating voltage and a corresponding oscillating current and alternating magnetic flux, and the stored energy is transferred to the load as heat. If the stored energy is not replenished by the power supply, the oscillating voltage eventually decays to zero, or "rings out," when all of the stored energy has been transferred to the load.

The greatest amount of energy is transferred from the induction head to the load during a first half-cycle of oscillation of the induction head. Therefore, to achieve maximum heating of a load, induction heating systems replenish the stored energy in the induction head upon completion of the first half-cycle of oscillation. However, maximum heating of a load is not always desirable. When a load requires only low-level heating, some induction heating systems utilize several cycles of the oscillating voltage to heat the load and employ some type of timing mechanism to replenish the stored energy in the resonant induction head after a given time has elapsed. However, the time required for the energy stored in the induction head to dissipate is load-dependent. If the load is smaller than anticipated or has been removed altogether, a substantial amount of stored energy could be remaining in the coil when the energy is replenished resulting in a potentially damaging over-current in the induction head.

Induction heating systems, particularly those employing resonant induction heads, would benefit from a simple low-level heating scheme that protects against potentially harmful over-current of the induction head.

SUMMARY OF THE INVENTION

The present invention provides an induction heating system. The induction heating system includes a power and a heating circuit configured to generate an oscillating voltage in response to a DC input pulse. The induction heating system further includes a pulse initiator configured to monitor the oscillating voltage across the resonant heating circuit and to initiate application of a subsequent DC pulse to the resonant circuit upon detecting that the average peak voltage of the oscillating voltage across the resonant circuit is at a level substantially equal to a predetermined minimum threshold value.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures.

DETAILED DESCRIPTION

Figure 1:
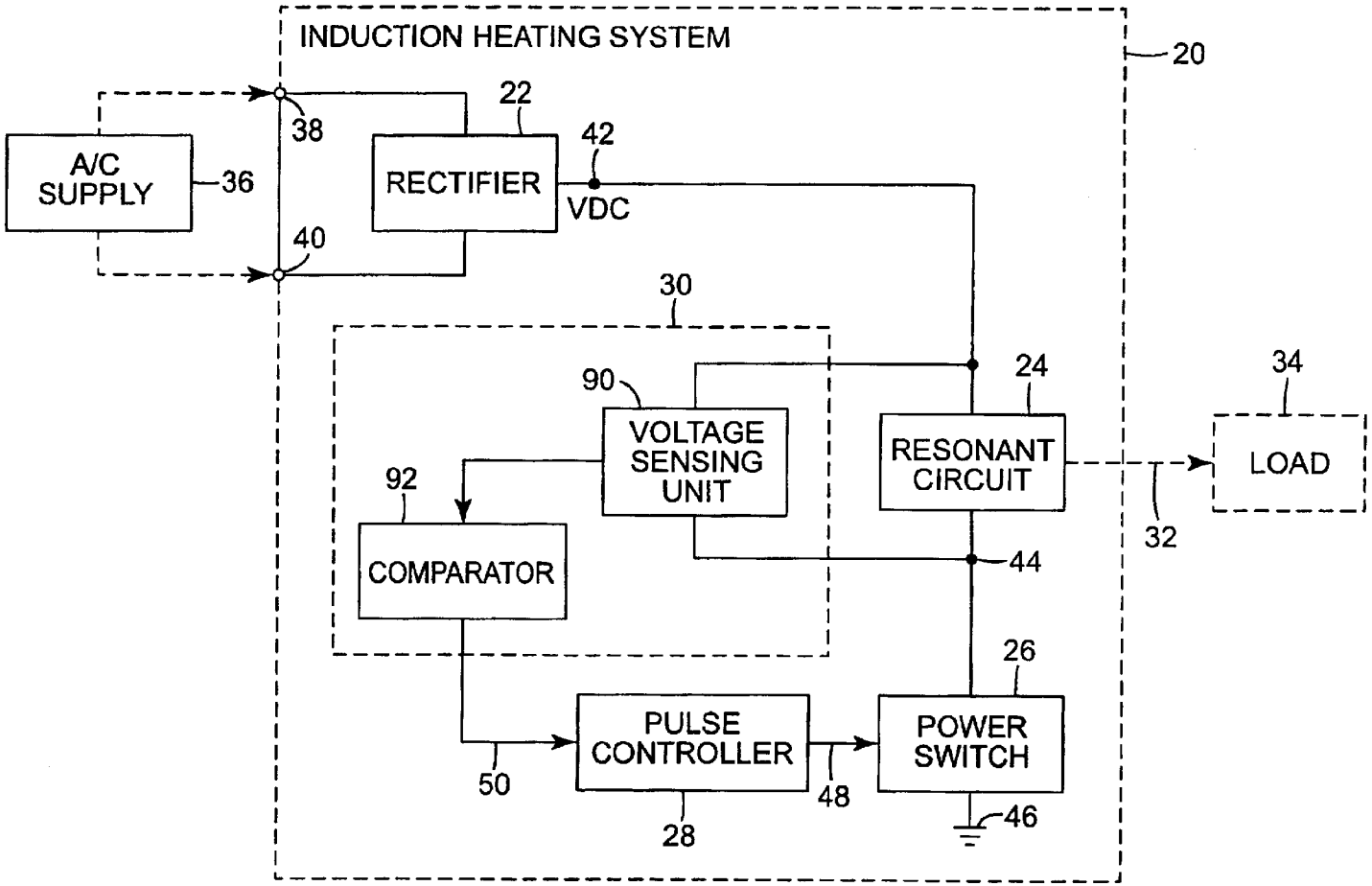
FIG. 1 is a block diagram illustrating one exemplary embodiment of an induction heating system according to the present invention.

In FIG. 1, an induction heating system in accordance with the present invention is generally indicated at 20. Induction heating system 20 includes a rectifier 22, a resonant heating circuit 24, a power switch 26, a pulse controller 28, and a pulse initiator 30. Induction heating system 20 is configured to be inductively coupled at 32 to an external electrically conductive load 34 and operates to control the switching of power switch 26 so as to provide low power heating of load 34 while preventing potentially harmful overloads of resonant heating circuit 24.

Rectifier 22 is connectable to an A/C power source 36 via a first input node 38 and a second input node 40, and is configured to provide a DC voltage level at a DC output node 42. Resonant heating circuit 24 is coupled between rectifier output node 42 and a node 44, and power switch 26 is coupled between node 44 and a ground node 46. Pulse controller 28 is configured to provide a switch control signal to power switch 26 via a path 48 to cause power switch 26 to first close and then, after an adjustable pulse duration, to open to thereby provide a DC voltage pulse across resonant heating circuit 24. In one embodiment, the length of the pulse duration is adjustable up to a maximum value based on a maximum amount of energy that resonant heating circuit 24 can store without sustaining damage.

Resonant heating circuit 24 is configured to store energy and generates an oscillating voltage and an associated oscillating current and alternating magnetic flux in response to the DC voltage pulse to thereby to heat inductively coupled external load 34. So long as subsequent DC voltage phases are not applied across resonant circuit 24, the oscillating voltage has a peak-to-peak voltage level that ultimately decays, or "rings out," to zero over time as the energy stored by resonant circuit dissipates. The time required for the oscillating voltage to ring-out is dependent on a plurality of factors including the length and magnitude to the DC voltage pulse, an internal impedance of the resonant circuit, and whether a load 34 is present. For a given DC voltage pulse, the oscillating voltage will ring-out to zero more quickly if a load, such as load 34, is being heated. If a subsequent DC pulse is applied to resonant circuit 24 before a sufficient amount of energy has been dissipated, resonant circuit 24 could suffer potential damage if the amount of energy attempted to be stored exceeds the maximum amount.

Pulse initiator 30 is coupled across resonant circuit 24 and configured to monitor an average of the peak-to-peak voltage of the oscillating voltage. Pulse initiator 30 is further configured to provide a pulse initiation signal to pulse controller 30 via a path 50 to cause pulse controller 30 to initiate application of a subsequent DC voltage pulse to resonant heating circuit 24 when the average peak-to-peak voltage generated by resonant circuit 24 diminishes to a level substantially equal to a predetermined set-point. The predetermined set-point is a value such that application of the subsequent pulse will not impart sufficient energy to damage resonant heating circuit 24. Thus, induction heating system 20 provides safe low-power heating of external load 34 by initiating a subsequent DC voltage pulse only when the peak-to-peak voltage of the oscillating voltage generated by resonant circuit 24 diminishes to the predetermined set-point.

Figure 2:
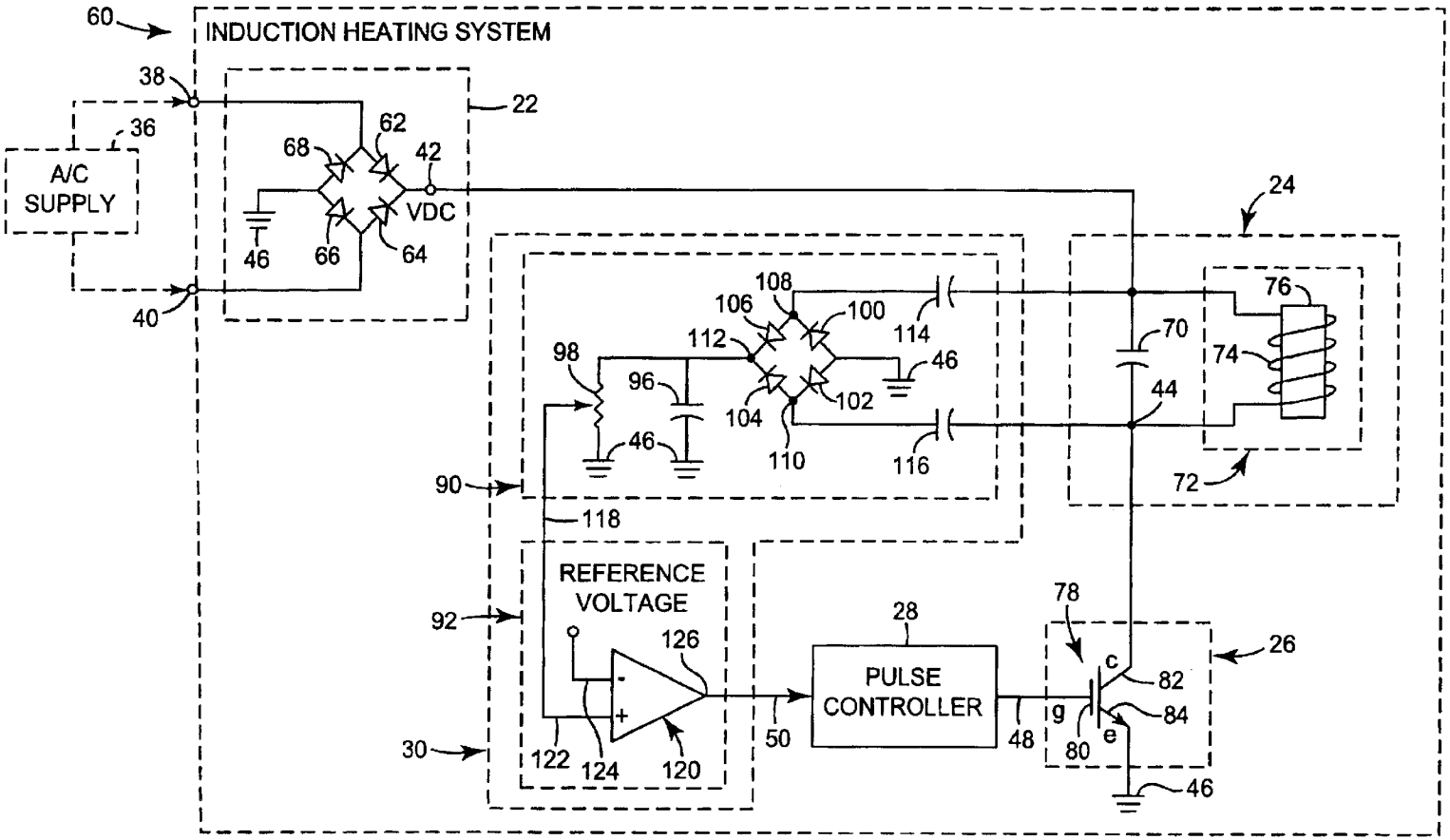
FIG. 2 is a schematic and block diagram illustrating one exemplary embodiment of an induction heating system according to the present invention.

FIG. 2 is a schematic and block diagram 60 illustrating one exemplary embodiment of induction heating system 20 according to the present invention. Rectifier 22 is a standard diode bridge rectifier comprising four diodes 62, 64, 66, and 68. First diode 62 has an anode coupled to first input node 38 and a cathode coupled to output node 42. Second diode 64 has an anode coupled to second input node 40 and a cathode coupled to DC output node 42. Third diode 66 as an anode coupled to ground 46 and a cathode coupled to first input node 38. Fourth diode 68 has an anode coupled to ground 46 and a cathode coupled to second input node 40. Rectifier 22 is connectable to external A/C supply 36 and configured to provide a DC voltage level ($V_{DC}$) at DC output node 42.

Resonant heating circuit 24 comprises a resonant capacitor 70 and a working head 72 comprising an inductive heating coil 74 around a ferrite core 76. Resonant capacitor is coupled in parallel with inductive heating coil 74 and has a first terminal coupled to rectifier output node 42 and a second terminal coupled to node 44. Resonant heating circuit 24 is configured to generate an oscillating voltage and an associated oscillating current and alternating magnetic flux in ferrite core 76 in response to a DC voltage pulse to thereby to heat inductively coupled external load 34. In one embodiment, working head 72 is coupled to resonant capacitor 70 using flexible leads that enable working head 72 to be moveable with respect to inductive heating system 20 and to be placed in contact with remote loads that are to be heated, such as load 34. In one embodiment, working head 72 does not include ferrite core 76.

Power switch 26 comprises an insulated gate bipolar transistor (IGBT) 78 having a gate 80, a collector 82 coupled to node 44, and an emitter 84 coupled to ground 46. Pulse controller 28 is configured to provide a switch control signal to gate 80 of power switch 26 via path 48 to cause power switch 26 to first close and then, after a duration, to open to thereby provide the DC voltage pulse to resonant heating circuit 24. In one embodiment, pulse controller 28 is configured to close power switch 26 after initial power-up of induction heating system 20 to thereby initiate a first DC voltage pulse to resonant heating circuit 24, and to thereinafter close power switch 26 to initiate subsequent DC voltage pulse to resonant heating circuit 24 based on receipt of the pulse initiation signal via path 50 from pulse initiator 30.

Pulse initiator 30 is coupled in parallel with power switch 26 and comprises a voltage sensing circuit 90 and a comparator 92. Voltage sensing circuit 90 includes a full-wave bridge rectifier 94, a smoothing capacitor 96, and a potentiometer 98. Full-wave bridge rectifier 94 comprises four diodes 100, 102, 104, and 106 configured to form a conventional bridge rectifier. Diode 100 has an anode coupled to ground 46 and a cathode coupled to a first input node 108. Diode 102 has an anode coupled to ground 46 and a cathode coupled to a second input node 110. Diode 104 has an anode coupled to second input node 110 and a cathode coupled to an output node 112. Diode 106 has an anode coupled to first input node 108 and a cathode coupled to output node 112. Bridge rectifier 94 is capacitively coupled across resonant circuit 24 via a first capacitor 114 coupled between first input node 108 and DC output node 42, and a second capacitor 116 coupled between second input node 110 and node 44. Smoothing capacitor 96 is coupled between output node 112 and ground 46. Potentiometer 98 has a first terminal coupled to output node 112, a second terminal coupled to ground 46, and an adjustable leg coupled to comparator 92 via a path 118.

When power switch 26 is in a closed position, node 44 is brought to ground and causes a DC voltage pulse to be applied across resonant heating circuit 24 and energy to accumulate in inductive heating coil 74. When the DC pulse is removed from resonant circuit 24 by opening power switch 26, inductive heating coil 74 discharges into resonant capacitor 70 and resonant heating circuit 24 begins to resonate and generate an oscillating voltage. Bridge rectifier 94 provides a full-wave rectified version of the oscillating voltage at output node 112. Smoothing capacitor 96 and potentiometer 98 filter the full-wave rectified oscillating voltage at 112 and provide a damped sinusoidal waveform across potentiometer 98 having a voltage level that is substantially equal to the peak voltage of the oscillating voltage. The adjustable leg of potentiometer provides a voltage representative of the peak voltage to comparator 92 via path 118.

Comparator 92 comprises an operational amplifier 120 having a non-inverting input 122 coupled to the adjustable leg of potentiometer 98, an inverting input 124 receiving a predetermined DC threshold value, and an output 126 coupled to pulse controller 28 via path 50. When the representative value of the average peak value of the full-wave rectified oscillating voltage at non-inverting terminal 122 drops to a value substantially equal to the predetermined DC threshold value at inverting terminal 124, operational amplifier 120 provides a pulse initiation signal at output 126 to cause pulse controller 28 to initiate application of a subsequent DC voltage pulse to resonant circuit 24. In other words, when the oscillating voltage decays to a value substantially equal to the predetermined DC threshold value, the amount of energy stored by resonant circuit 24 has dissipated to a level such that application of the subsequent DC voltage pulse will not result in resonant circuit 24 being over-charged.

Figure 3A:
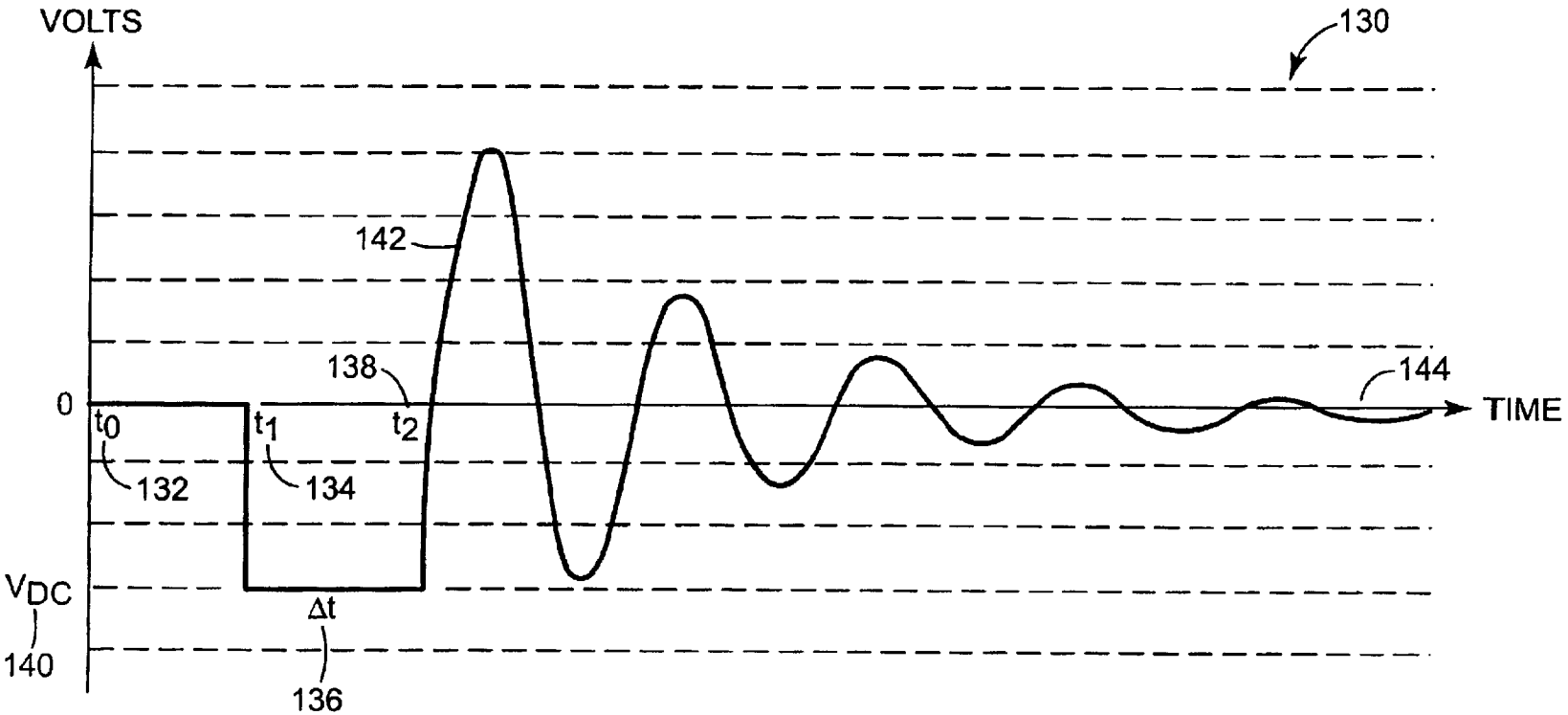
FIG. 3A is a graph illustrating an exemplary voltage waveform across the resonant heating circuit according to the present invention.

The operation of induction heating system 20 as illustrated in FIG. 2 is described below. FIG. 3A is an exemplary graph 130 of the voltage across resonant heating circuit 24 between DC output node 42 and node 44. At initial power-up of induction heating systems 20 at time $t_0$, as indicated at 132, power switch 26 is open and the voltage across resonating circuit 24 is at zero. After the initial power-up of induction heating system 20, pulse controller 28 is configured to provide a power switch control signal to gate 80 via path 48 to cause IGBT 78 to become forward-biased and pull collector 82 to ground 46 via emitter 84, as indicated at time $t_1$ at 134. Pulse controller 28 is configured to maintain IGBT 78 in a forward-biased condition for a duration ($\Delta t$) 136 from $t_1$ 134 to time $t_2$, at 138. During this duration, collector 82 is shorted to ground 46 via emitter 84, resulting in a DC pulse having a magnitude substantially equal to the DC voltage ($V_{DC}$) 140 provided at output node 42 and the duration of $\Delta t$ 136 being applied across resonant heating circuit 24 and causing energy to accumulate in inductive coil 74.

At time $t_2$ 138, pulse controller 28 provides a power switch control signal to gate 80 to cause IGBT 78 to become reverse-biased, causing IGBT 78 to no longer conduct to ground and thereby terminate the DC pulse to resonant circuit 24. Inductive coil 74 then begins to discharge into resonant capacitor 70 and resonant heating circuit 24 begins generating an oscillating voltage, as indicated at 142, which in-turn generates a corresponding oscillating flux in ferrite core 76 to heat external load 34. If no additional DC voltage pulses are applied to resonant heating circuit 24, oscillating voltage 142 gradually decays, or "rings-out," to zero, as indicated at 144.

Figure 3B:
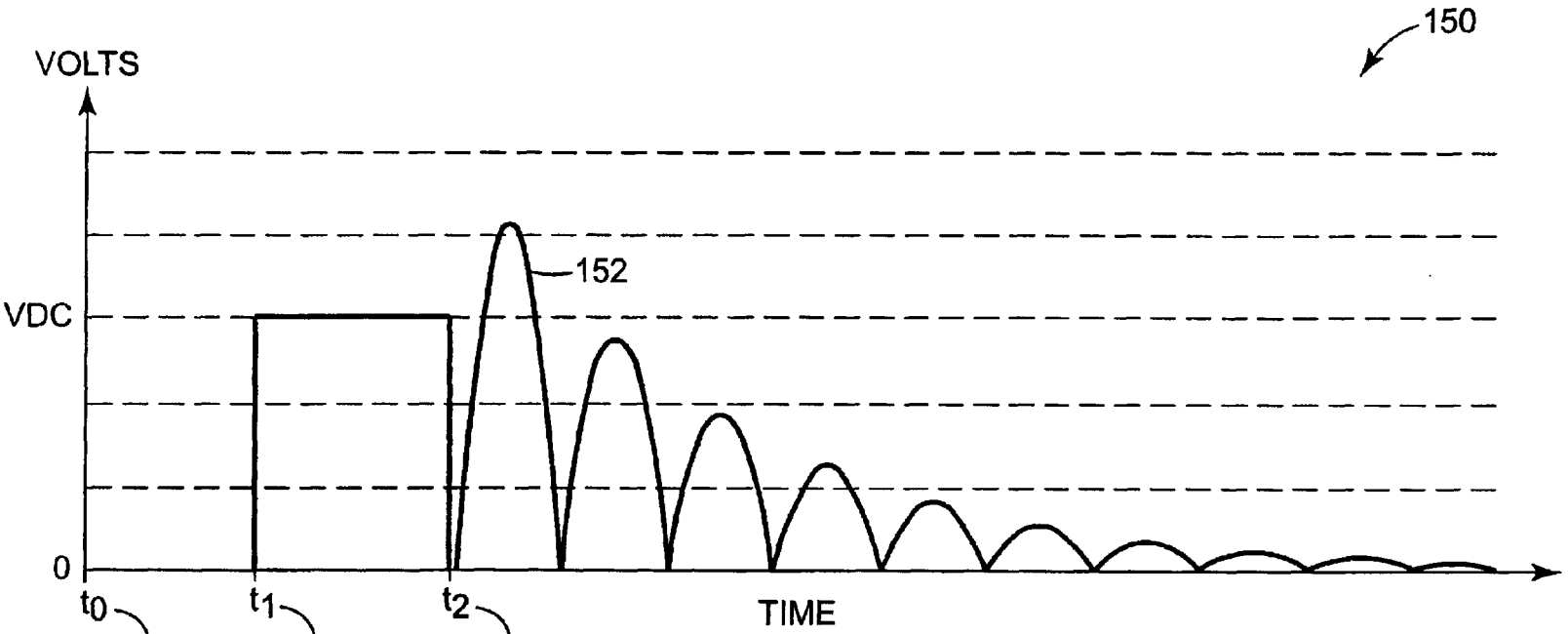
FIG. 3B is a graph illustrating an exemplary full-wave rectified voltage waveform as provided by the bridge rectifier according to the present invention.
Figure 3C:
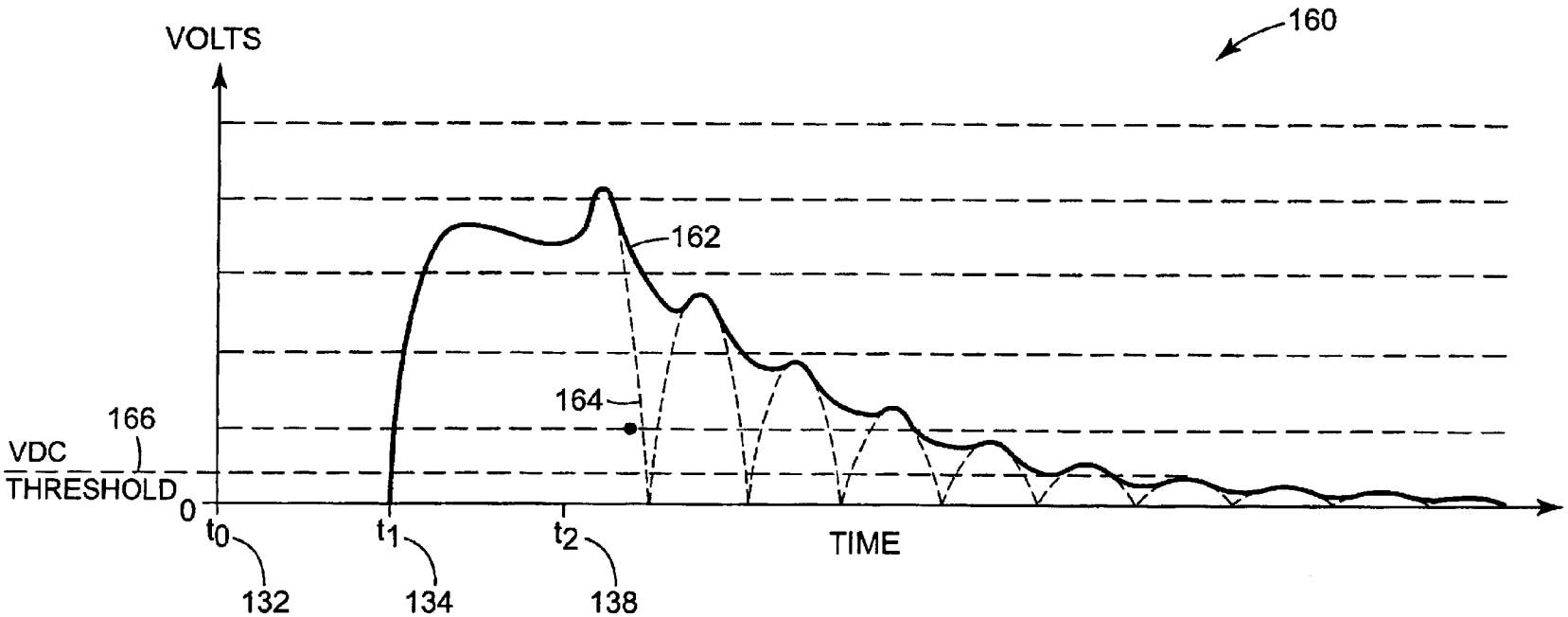
FIG. 3C is a graph illustrating an exemplary filtered voltage waveforms as provided to a comparator according to the present invention.

Also at time t2 138, as resonant circuit 24 begins to oscillate, bridge rectifier 94 provides a full-wave rectified version of the oscillating voltage at node 112. FIG. 3B is an exemplary graph 150 of the full-wave rectified waveform 152 provided at node 112 by bridge rectifier 94. Capacitor 96 and potentiometer 98 receive full-wave rectified waveform at node 112 and provide a filtered version of the full-wave rectified waveform across potentiometer 98. FIG. 3C is an example graph 160 of the filtered waveform 162 across potentiometer 98. Filtered waveform 162 approximates an average peak voltage of the full-wave rectified waveform as represented by dashed curve 164.

Comparator 92 receives a voltage representative of the average peak voltage from the adjustable leg of potentiometer 98 via path 118 at non-inverting terminal 122 of operational amplifier 120. Comparator 92 compares the value of the average peak voltage at non-inverting terminal 122 to the predetermined DC threshold voltage, indicated at 166 in FIG. 3, received at inverting terminal 124. When the representative value of the average peak value of the full-wave rectified oscillating voltage drops to a value substantially equal to the predetermined DC threshold voltage, operational amplifier 120 provides a pulse initiation signal at output 126 to cause pulse controller 28 to initiate application of a subsequent DC voltage pulse to resonant circuit 24. The predetermined DC threshold value has a value such that when a peak value of the oscillating voltage drops to the DC threshold value, the amount of energy stored by resonant circuit 24 has dissipated to a level such that application of the subsequent DC pulse will not damage resonant circuit 24.

Figure 4:
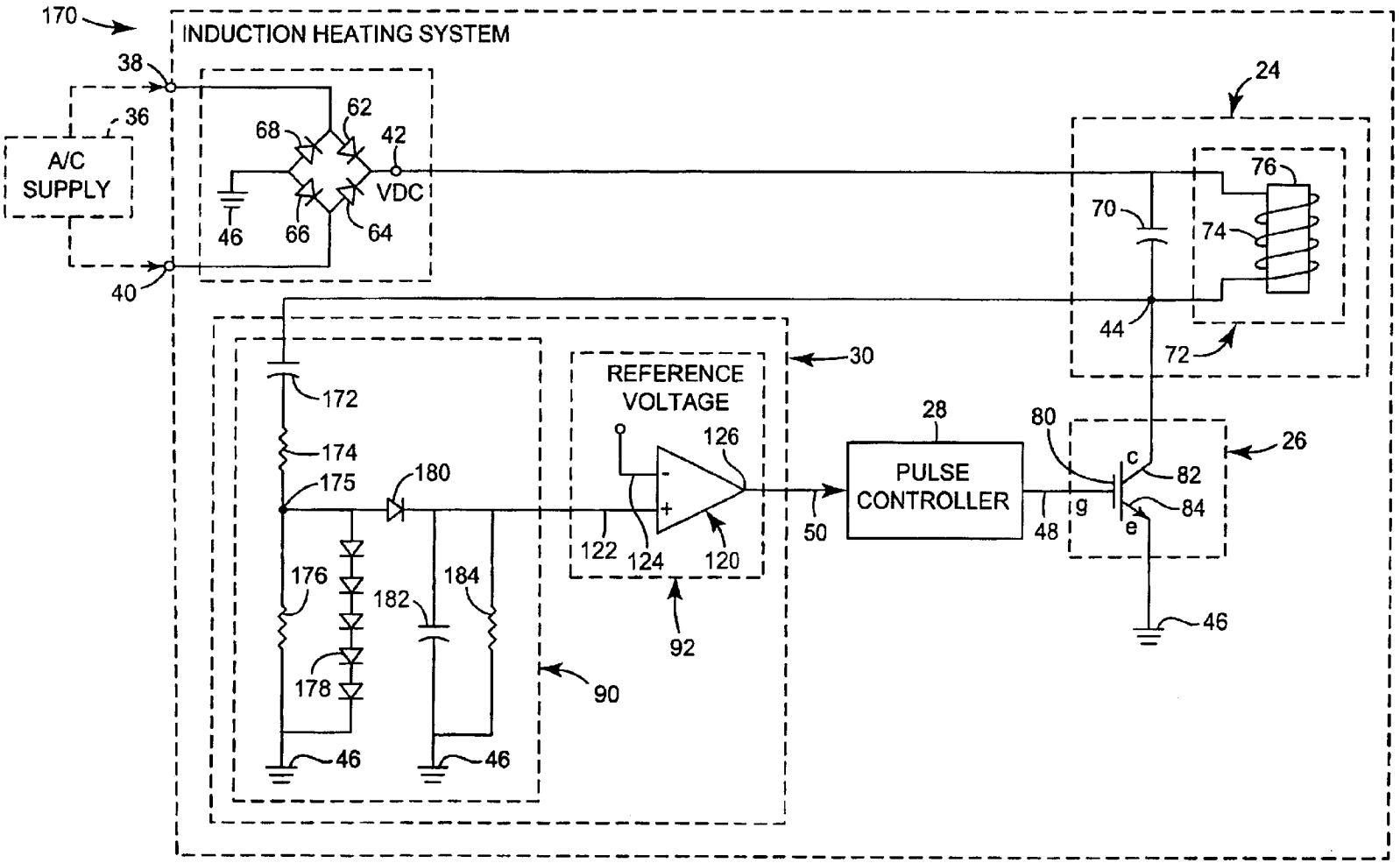
FIG. 4 is a schematic and block diagram illustrating one exemplary embodiment of an induction heating system according to the present invention.

FIG. 4 illustrates another exemplary embodiment 170 of an induction heating system 20 according to the present invention. Induction heating system 170 is similar to induction heating system 20 previously described herein. In this embodiment, however, pulse initiator 30 is coupled across power switch 26 and voltage sampling circuit 90 is configured to provide to comparator 92 a value representative of the average peak voltage of the oscillating voltage generated by resonant heating circuit 24 that is based on a half-wave rectified version of the oscillating voltage.

In this regard, voltage sampling circuit 90 is capacitively coupled to node 44 via a coupling capacitor 172 having a first terminal coupled to node 44 and a second terminal. A dropping resistor 174 has a first terminal coupled to the second terminal of coupling capacitor 172 and a second terminal coupled to a monitoring node 175. A monitoring resistor 176 is coupled between monitoring node 175 and ground 46. Dropping resistor 174 and monitoring resistor 176 function as a voltage divider with a monitoring voltage across monitoring resistor 176 being representative of the oscillating voltage generated by resonant heating circuit 24.

A plurality of diodes 178 are series-connected diodes cathode-to-anode in parallel with monitoring resistor 176 with an anode of the first diode of the plurality coupled to monitoring node 175 and a cathode of the last diode of the plurality coupled to ground 46. The plurality of diodes 178 functions to limit the monitoring voltage across monitoring resistor 176 to thereby limit a voltage at non-inverting input 122 to prevent potential damage to operational amplifier 122.

A diode 180 has an anode coupled to monitoring node 175 and a cathode coupled to non-inverting input 122 and functions to provide at non-inverting input 122 a half-wave rectified version of the monitoring voltage across monitoring resistor 176. A capacitor 182 and resistor 184 are coupled in parallel between non-inverting terminal 122 and ground 46, and function to filter the half-wave rectified waveform provided by diode 180 to thereby provide a filtered waveform at non-inverting terminal 122 that is representative of an average peak value of the oscillating voltage generated by resonant heating circuit 24.

When power switch 26 is in a closed position, node 44 is brought to ground which effectively removes pulse initiator 30 from the system while a DC voltage pulse is being applied across resonant heating circuit 24. When the DC voltage pulse is removed from resonant circuit 24 by opening power switch 26, resonant heating circuit 24 begins to generate an oscillating voltage. The sum of the DC voltage level at DC output node 42 and the oscillating voltage generated by resonant circuit 24 is present from node 44 to ground 46 across switch 26. Coupling capacitor 172 substantially removes the DC component and thus the oscillating voltage is present across dropping resistor 174 and monitoring resistor 176, with a majority of the oscillating voltage appearing across dropping resistor 94 and the monitoring voltage appearing across monitoring resistor 176 from monitoring node 175 to ground 46.

Diode 180 then provides a half-wave rectified version of the monitoring voltage across monitoring resistor 176, which is subsequently filtered by capacitor 182 and resistor 184. The filtered waveform is representative is representative of the average peak value of the half-wave rectified voltage provided by diode 180, and is provided to non-inverting input 122 of operational amplifier 120 for comparison to the predetermined DC threshold voltage at inverting input 124.

Numerous characteristics and advantages of the invention have been set forth in the foregoing description. It will be understood, of course, that this disclosure is, and in many respects, only illustrative. Changes can be made in details, particularly in matters of shape, size and arrangement of parts without exceeding the scope of the invention. The invention scope is defined in the language in which the appended claims are expressed.

What is claimed is:

1. An induction heating system comprising:

a power switch;

a resonant heating circuit configured to be coupled to a load and configured to generate an oscillating voltage in response to a DC voltage pulse; and a pulse initiator configured to provide a monitoring voltage having a value representative of an average value of a peak voltage of the oscillating voltage generated by the resonant heating circuit and to provide a pulse initiation signal to initiate application of a subsequent DC voltage pulse to the resonant heating circuit when the value of the monitoring voltage is substantially equal to or less than a predetermined threshold value.

2. The induction heating system of claim 1, wherein the power switch is configured to close and open to provide the DC voltage pulses.

3. The induction heating system of claim 2, wherein the power switch is configured to open and close in response to a switch control signal.

4. The induction heating system of claim 3, further comprising:

a pulse controller positioned between the pulse initiator and the power switch and configured to provide the switch control signal to the power switch, wherein response to the pulse initiator detecting that the average power across the resonant heating circuit is at a level substantially equal to a predetermined minimum threshold value and the pulse controller provides a switch control signal that causes the power switch to close.

5. The induction heating system of claim 4, wherein after causing the power switch to close the pulse controller is configured to provide, after a time duration, a switch control signal that causes the power switch to open.

6. The induction heating system of claim 5, wherein the time duration is a predetermined fixed value substantially equal to a maximum allowable duration based upon a maximum storage capacity of the resonant heating circuit.

7. The induction heating system of claim 5, wherein the time duration is a adjustable between a minimum value and a maximum value wherein the maximum value is duration based upon a maximum storage capacity of the resonant heating circuit.

8. The induction heating system of claim 1, wherein the pulse initiator comprises:

a voltage sampling circuit configured to provide a monitoring voltage representative of an average peak-to-peak voltage of the oscillating voltage of the resonant heating circuit; and a level determinator configured to receive the monitoring voltage and configured to initiate application of the subsequent DC voltage pulse when a level of the average peak-to-peak voltage of the oscillating voltage is substantially equal to a predetermined minimum threshold value.

9. The induction heating system of claim 8, wherein the level determinator comprises a comparator circuit.

10. The induction heating system of claim 8, wherein the voltage sampling circuit comprises:

a full-wave rectifier having a pair of input nodes respectively coupled across the resonant circuit by a first and second capacitor and having a first output node coupled to ground and a second output node;

a smoothing capacitor coupled across the full-wave rectifier output nodes; and a resistor coupled in parallel with the smoothing capacitor, wherein a voltage across the resistor is the monitoring voltage.

11. The induction heating system of claim 9, wherein the comparator comprises:

an operational amplifier having a non-inverting input coupled to the resistor, an inverting signal configured to receive the predetermined minimum threshold value, and an output configured to initiate application of the subsequent DC voltage pulse when a level of the average peak-to-peak voltage of the oscillating voltage is substantially equal to the predetermined minimum threshold value.

12. The induction heating system of claim 1, wherein the power switch comprises:

an insulated gate bipolar transistor (IGBT) having a gate configured to receive a switch control signal, a collector coupled to the resonant heating circuit and an emitter coupled to ground.

13. A method of operating an inductive heating system, the method comprising:

operating a power switch to apply a DC voltage pulse to a resonant heating circuit;

generating with the resonant heating circuit an oscillating voltage in response to the DC voltage pulse; and applying a subsequent DC voltage pulse to the resonant heating circuit upon detecting that the average peak-to-peak voltage of the oscillating voltage across the resonant heating circuit is at a level substantially equal to a predetermined minimum threshold value.

14. The method of claim 13, wherein operating the power switch comprises:

closing and opening the power switch.

15. The method of claim 13, wherein detecting the average peak-to-peak voltage of the oscillating voltage comprises:

providing a monitoring voltage representative of the average peak-to-peak voltage of the oscillating voltage across the resonant heating circuit;

comparing the monitoring voltage to a minimum threshold value; and closing the power switch when the monitoring voltage is substantially equal to the minimum threshold value to thereby initiate application of a subsequent DC voltage pulse to the resonant heating circuit.

16. An induction heating system connectable to an AC source, the system comprising:

a rectifier connectable on the AC source and configured to provide a DC voltage at a DC output node;

a power switch having a first terminal, a second terminal coupled to ground, and a control gate;

a resonant heating circuit coupled between the DC output node and the first terminal of the power switch;

a pulse controller configured to provide a control signal to the power switch control gate to open and close the power switch to thereby provide a DC voltage pulse to the resonant heating circuit causing the resonant heating circuit to generate an oscillating voltage; and a pulse initiator coupled in parallel with the resonant heating circuit and configured to monitor an average voltage across the resonant heating circuit and to provide a control signal to the pulse controller instructing the pulse controller to close the power switch to thereby initiate application of a subsequent DC voltage pulse to the resonant heating circuit when the average voltage across the resonant heating circuit falls to a level substantially equal to a predetermined threshold value.

17. The induction heating system of claim 16, wherein the power switch comprises:

an insulated gate bipolar transistor (IGBT) having a gate configured to receive the control signal, a collector coupled to the resonant heating circuit, and an emitter coupled to ground.

18. The induction heating system of claim 16, wherein the pulse initiator comprises:

a voltage sampling circuit coupled in parallel with the resonant heating circuit and configured to provide a monitoring voltage representative of an average peak-to-peak voltage of the oscillating voltage of the resonant heating circuit; and a comparator configured to receive the monitoring voltage and configured to provide the control signal to the pulse controller when a level of the average peak-to-peak voltage of the oscillating voltage is substantially equal to the predetermined threshold value.

19. The induction heating system of claim 18, wherein the voltage sampling circuit comprises:

a full-wave rectifier having a pair of input nodes respectively coupled across the resonant heating circuit by a first and second capacitors and having a first output node coupled to ground and a second output node;

a smoothing capacitor coupled across the full-wave rectifier output nodes; and a resistor coupled in parallel with the smoothing capacitor, wherein a voltage across the resistor is the monitoring voltage.

20. The induction heating system of claim 18, wherein the comparator comprises:

an operational amplifier having a non-inverting input coupled to a resistor, an inverting signal configured to receive the predetermined threshold value, and an output configured to provide the control signal to the pulse controller.

21. The induction heating system of claim 16, wherein the resonant heating circuit comprises:

a capacitor having a first terminal coupled to the DC output node and a second terminal coupled to the second terminal of the power switch; and an inductive heating coil coupled in parallel with the capacitor.

22. The induction heating system of claim 21, wherein the inductive heating coil is inductively coupled to a working head.

* * * * *

UNITED STATES PATENT AND TRADEMARK OFFICE

CERTIFICATE OF CORRECTION

PATENT NO. : 6,943,330 B2
DATED : September 13, 2005
INVENTOR(S) : Ring, Edmund J.

It is certified that error appears in the above-identified patent and that said Letters Patent is hereby corrected as shown below:

Column 2
Line 42, delete “waveforms” and insert -- waveform --, therefor.

Column 4,
Line 27, after “diodes” insert -- , --.

Column 8,
Line 64, delete “on” and insert -- to --, therefor.

Signed and Sealed this

Fifteenth Day of November, 2005

JON W. DUDAS
*Director of the United States Patent and Trademark Office*